US011262148B1

(12) United States Patent
Lessie et al.

(10) Patent No.: US 11,262,148 B1
(45) Date of Patent: Mar. 1, 2022

(54) LOCK

(71) Applicant: SFUS Inc., Washington, DC (US)

(72) Inventors: Jake Lessie, Carlsbad, CA (US); Jonah Zaleznick, San Diego, CA (US); Kyle Downey, Front Royal, VA (US); Steven Zaleznick, Washington, DC (US)

(73) Assignee: SFUS INC., Washington, DC (US)

( * ) Notice: Subject to any disclaimer, the term of this patent is extended or adjusted under 35 U.S.C. 154(b) by 0 days.

(21) Appl. No.: 17/180,252

(22) Filed: Feb. 19, 2021

(51) Int. Cl.
*F41A 17/44* (2006.01)
*F41A 17/04* (2006.01)
*E05B 37/02* (2006.01)

(52) U.S. Cl.
CPC ..... *F41A 17/44* (2013.01); *E05B 37/02* (2013.01); *E05B 37/025* (2013.01); *F41A 17/04* (2013.01)

(58) Field of Classification Search
CPC ..... F41A 17/04; F41A 17/00; F41A 17/44; E05B 37/02; E05B 37/025
See application file for complete search history.

(56) References Cited

U.S. PATENT DOCUMENTS

| | | | | |
|---|---|---|---|---|
| 2,479,107 A | | 8/1949 | Garretson | 42/70.11 |
| 2,887,807 A | | 5/1959 | Santangelo | 42/70.11 |
| 3,595,426 A | * | 7/1971 | Conrad | E05B 37/02 220/255 |
| 3,768,189 A | * | 10/1973 | Goodrich | B65D 55/14 42/96 |
| 4,398,366 A | | 8/1983 | Wernicki | 42/70.11 |
| 4,512,099 A | | 4/1985 | Mathew | 42/70.11 |
| 4,908,971 A | | 3/1990 | Chaney | 42/70.11 |
| 4,961,277 A | | 10/1990 | Rosenbaum | 42/70.11 |
| 5,048,211 A | | 9/1991 | Hepp | 42/70.11 |
| 5,289,653 A | | 3/1994 | Szebeni | 42/70.11 |
| 5,398,438 A | | 3/1995 | Williams | 42/70.11 |
| 5,491,918 A | | 2/1996 | Elmstedt | 42/70.11 |
| 5,664,358 A | | 9/1997 | Haber | 42/44 |
| 5,699,687 A | | 12/1997 | Pittman | 42/70.11 |
| 5,715,709 A | | 2/1998 | Lai | 70/25 |
| 5,860,241 A | | 1/1999 | Waters | 42/66 |
| 5,870,909 A | | 2/1999 | Saunders, Jr. et al. | 70/23 |
| 6,526,684 B1 | | 3/2003 | Hickerson | 42/70.11 |
| 6,560,910 B1 | * | 5/2003 | McLaren | F41A 17/04 42/70.11 |
| 6,578,308 B2 | | 6/2003 | Hickerson | 42/70.11 |
| 6,634,130 B1 | | 10/2003 | Balchunas | 42/70.11 |
| 6,701,655 B2 | | 3/2004 | Milo | 42/70.11 |
| 6,862,831 B1 | | 3/2005 | Canaday | 42/66 |
| 6,895,707 B2 | | 5/2005 | Young | 42/70.11 |
| 7,150,122 B1 | | 12/2006 | Ha | 42/70.11 |

(Continued)

*Primary Examiner* — Joshua E Freeman
(74) *Attorney, Agent, or Firm* — Stein IP, LLC

(57) ABSTRACT

A lock has improved protection against lock picking. The lock comprises plural tumblers, each generally cylindrical in form with outer and inner circumferential edges, all the tumbles arranged on a common axis. The outer circumferential edge of each tumbler having a single true gate, including a void extending a predetermined distance toward the axis and plural false gates, each having a void of lesser extent. Ridges separates the true gate from adjacent false gates, and separate adjacent false gated from each other. The lock also includes a sheath contacting the inner circumferential edges of the tumblers. The sheath includes ridges located to maintain the tumblers in contact with each other.

12 Claims, 13 Drawing Sheets

(56) References Cited

U.S. PATENT DOCUMENTS

| | | | | |
|---|---|---|---|---|
| 7,849,625 | B2 | 12/2010 | Ligard | 42/70.11 |
| 9,487,969 | B2 | 11/2016 | Lai | 37/58 |
| 9,784,517 | B2 | 10/2017 | Pittman | |
| 9,803,944 | B2 | 10/2017 | Pittman | |
| 10,167,655 | B2 | 1/2019 | Albertson et al. | 45/8 |
| 10,280,646 | B2 | 5/2019 | McLennan | 27/57 |
| 10,428,556 | B2 | 10/2019 | Bowley et al. | 27/1 |
| 10,597,906 | B2 | 3/2020 | Engibarov et al. | 70/2 |
| 10,648,754 | B2 | 5/2020 | Sun | |
| 11,029,111 | B2 * | 6/2021 | Dagher | F41A 17/44 |
| 2001/0034961 | A1 | 11/2001 | Hickerson | 42/70.11 |
| 2002/0133999 | A1 * | 9/2002 | Polenz | F41A 17/44 42/70.11 |
| 2004/0200114 | A1 | 10/2004 | Milo | 42/70.11 |
| 2005/0166635 | A1 | 8/2005 | Kawabuchi et al. | 63/32 |
| 2006/0162221 | A1 * | 7/2006 | McLaren | F41A 17/44 42/70.11 |
| 2013/0055933 | A1 * | 3/2013 | Markman | E05G 1/005 109/50 |
| 2017/0174394 | A1 * | 6/2017 | Pence | E05G 1/005 |
| 2020/0072570 | A1 | 3/2020 | Sun | |
| 2020/0386501 | A1 * | 12/2020 | Dagher | F41A 17/44 |

* cited by examiner

LOCK

RELATED APPLICATION

This application is related to prior application Ser. No. 16/876,846 filed May 18, 2020 and published as US 2020/0386501 on Dec. 10, 2020. The subject matter of that application is incorporated herein by this reference.

BACKGROUND OF THE INVENTION

Locks have an important function in providing protection. Locks benefit from resistance to tampering. An object which may be protected by a lock is a firearm. The art includes firearm locks, such as McLaren U.S. Pat. No. 6,560,910.

SUMMARY

This application describes two embodiments of a lock. One of the embodiments may be applied to protect a firearm. In this gun lock embodiment, the lock has a user manipulatable proximate end and a distal end. The distal end fits in the barrel of a firearm which is to be protected. In response to particular user operations on a user manipulatable portion, the lock responds to the user manipulation resulting in the distal end transiting between a lock condition and an unlock condition or between a unlock condition and a lock condition. A gun lock which has been applied to a gun and is in a lock condition engages with the gun in such a way as to prevent use of the gun. Because the lock is in a lock condition it can only be removed to allow normal operation of the gun if the gun lock transits to an unlock condition.

In this gun lock embodiment, the locking apparatus includes a plurality of tumblers each of which may be rotated by a user. Each tumbler has several discrete positions. The positions may be defined by a detent mechanism. One of the positions is referred to as a coded position. The coded position for one tumbler may be the same as or different from the coded position of other tumblers. When all the tumblers are in their respective coded positions, the lock may transit to an unlock condition. Once all tumblers are in their coded position the user may manipulate other components of the lock to transit the lock to an unlock condition in which the firearm may be unlocked and released from the gunlock.

A second embodiment of the invention protects the contents of a container. The second embodiment has many of the same components as the first embodiment. In this embodiment too, the lock has a lock and unlock condition. When all the tumblers are in their coded position the user may manipulate other components of the lock to transition to the unlock condition. The container protected by the lock has an internal region which is accessible only by opening a cover. The cover may only be opened when the lock achieves its unlock condition. If the cover is closed and the lock is in a locked condition any contents of the container are unavailable.

In each embodiment the lock includes a number of elements that provide for enhanced resistance from tampering. A summary of those elements includes:

Each of the plurality of tumblers is of cylindrical form with first and second faces generally parallel to each other. The tumblers have inner and outer circumferential surfaces, the outer circumferential surface including an outer circumferential edge. Each tumbler contains spaced plural distinct outer circumferential edge locations. The plural distinct locations include a single location with a circumferential void extending a prescribed distance away from the edge (referred to as a real gate) and plural other locations (false gates), each with a void of reduced dimension. The false gates provide the appearance or "feel" of the coded position to someone attempting to tamper with the lock.

A spring biased comb, with a tooth for each tumbler. The comb is free to traverse the tumblers in order to release or open the locking device, but only when all tumblers are in their coded position. The comb is dimensioned relative to the false gates so that a tooth of the comb will enter into a false gate in a manner that gives a feel similar to the feel someone manipulating the tumblers would receive by the entrance of a tooth into the real gate.

A sheathing that puts all the tumblers in contact. The sheathing includes ridges on its surface to contact an inner circumferential surface of said tumblers serving to maintain the spatial relation between the respective tumblers and the sheath.

Each of the tumblers has a coded position which is identified by a real gate (as opposed to a false gate). The real gate and the associated false gates are located on the opposite side of the tumbler from a user tab to which a user applies force to in order to move. i.e., rotate the tumbler.

The tumblers meet each other at an inter-tumbler region. The tumblers are cylindrical in form with two faces. The tumblers have a hub on one face, extending beyond the face and a complementary recess on the other face, the hub of one tumbler fits into the recess of an adjacent tumbler. The tumblers contain catch basins to preclude insertion of a shim into an inter-tumbler region. The catch basins are regions which prevent free movement of a shim and consequently prevent the user of a shim from acquiring information on the coded position of the tumbler.

DETAILED DESCRIPTION

Figure 1:
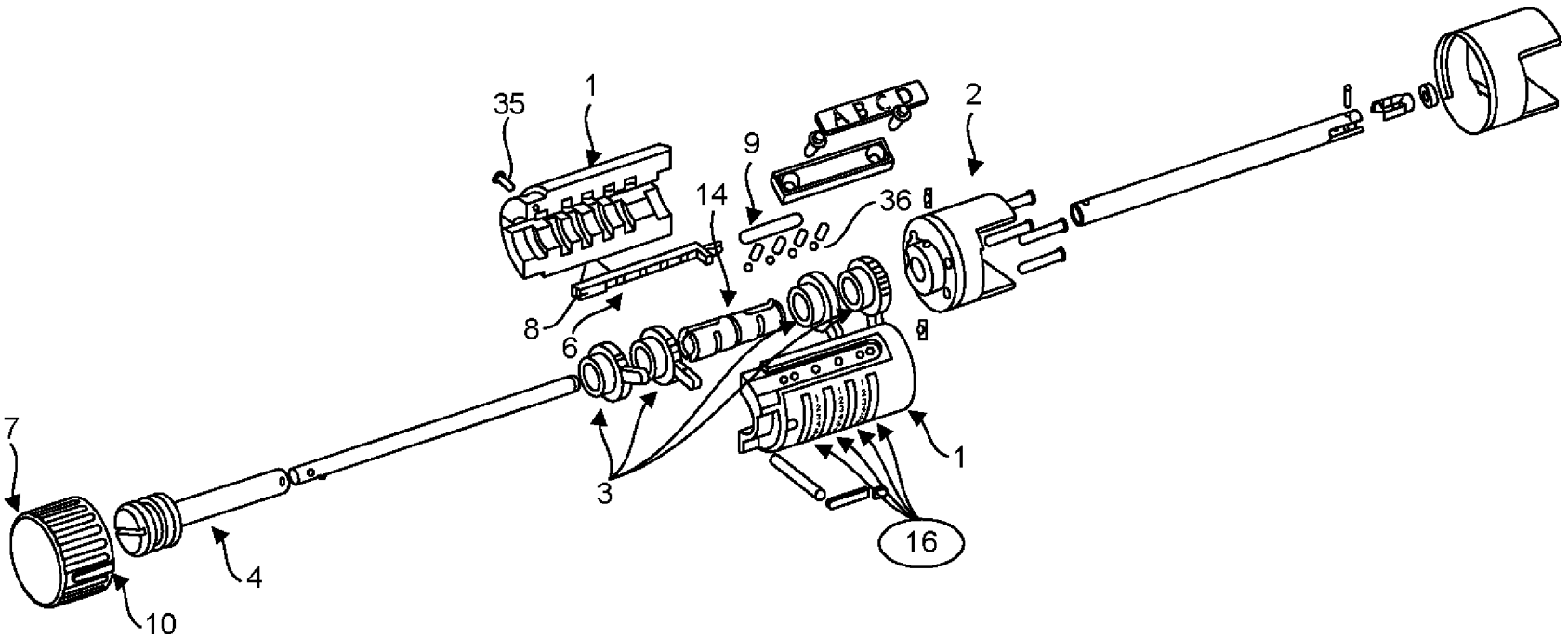
FIG. 1 is an exploded view of a gun lock embodiment particularly illustrating the user manipulatable components of the lock, including the tumblers.

FIG. 1 is an exploded view of a gun lock embodiment of the invention. The lock has proximal and distal ends, the proximal end is adjacent to the user manipulatable components and the distal end is the portion of the lock that may be inserted into the barrel of a weapon. At a proximal end of the gunlock are two half-circumferential base housings 1. The pair of housings 1 are pinned and fused (including screw connector 35 representing several screws) with attachment to the base receiver cap 2 (see also FIGS. 11 and 12). Contained within the two housings 1 are a set of tumblers 3. In the embodiment described herein there are four tumblers (it should be apparent that the number of tumblers may be varied to be more or less than the four tumblers which are illustrated), each of the tumblers can rotate on a linear actuating spindle 4. Each tumbler 3 has a single notch 5 (see also FIGS. 2-4) which establishes a coded position for the that tumbler. The notch 5 is also referred to as a real gate. The tumblers 3 may be rotated by a user to vary the rotatable position of the tumbler by applying a force to a tab 15. Each of the tumblers has a like number of stable rotatable positions established by a detent mechanism whose components are indicated schematically by the components referenced at 36 in FIG. 1. When all tumblers 3 of the lock are in their coded positions, each of the notches 5 will register so that the several teeth 13 of a comb 6 may be translated through a real gate of a different one of the tumblers. A knob 7 is pressed onto the spindle 4 and pinned against rotation relative to the spindle 4. The knob 7 includes a notch 10. A release tab 8 is fixed to the comb 6 and a spring 9 is attached to the comb 6 and the cap 2 to provide a force to stabilize the release tab 8 within the notch 10 against motion. When any one or more of the tumblers are out of its coded position, the comb 6 is prevented from translating. This prevention is a consequence of a tooth 13 of the comb impacting a tumbler at a position other than at the real gate. Prevention of movement of the comb 6 means that the tab 8 maintains engagement with the notch 10. This prevents rotation of the knob 7 and spindle 4 regardless of the force applied by a user to a release tab 8 or the knob 7.

When the tumblers 3 achieve their coded position, the inhibition to translation of the comb 6 past the tumblers is removed. At this time the user may apply a force to the release tab 8 removing the tab 8 from the notch 10. This motion of the tab 8 is only available when each of the tumblers in its coded position. If any tumbler is not in the coded position, one of the teeth 13 of the comb 6 will impinge in that tumbler at a location other than the notch 5 so as to prevent motion of the comb 6 and the tab 8. However, with all tumblers in their coded position each tooth of the comb 6 will register with a different one of the real gates of the tumblers. This allows motion of the comb 6 to a sufficient extent that the tab 8 can be withdrawn from the knob 7. When the release tab 8 is withdrawn from notch 10, the knob 7 is free to rotate. Rotation of knob 7 (through user action) results in rotation of the spindle 4. Rotation of the spindle 4 produces motion of components at the distal end of the gunlock. This motion alters the configuration of the distal end of the gun lock. Particularly, components at the distal end of the gunlock transit from a locked state, where the components of the gunlock at the distal end cannot be removed from the gun, to an unlocked state which allows the distal end of the gunlock to be removed from the gun barrel. The particular components of the gunlock at the distal end, the particular motion of the spindle 4 and how that motion produces unlocking of the gunlock are more completely described in the co-pending application Ser. No. 16/876,846 filed May 18, 2020 (published as US 2020/0386501 on Dec. 10, 2020), the subject matter of which is incorporated herein by this reference. In one embodiment the motion of the spindle generates rotation of the distal end of the gunlock which transits the lock to/from a lock/unlock condition. In a different embodiment the motion of the spindle generates translation of the distal end of the gunlock which transits the lock to/from a lock/unlock condition.

The gunlock has a plurality of tumblers 3, each tumbler can be rotated to anyone of plural positions. This allows many potential codes (where each tumbler's position represents one digit of a code), such that the correct code will be hard to determine through trial and error. The tumblers 3 are designed to be tactile, meaning that someone knowing the correct code can enter the code with reasonable speed and in a dark room. As will be described, this embodiment has specific roadblocks to defeat attempts to obtain information about the operative or correct code by merely manipulating the gunlock.

Figure 2:
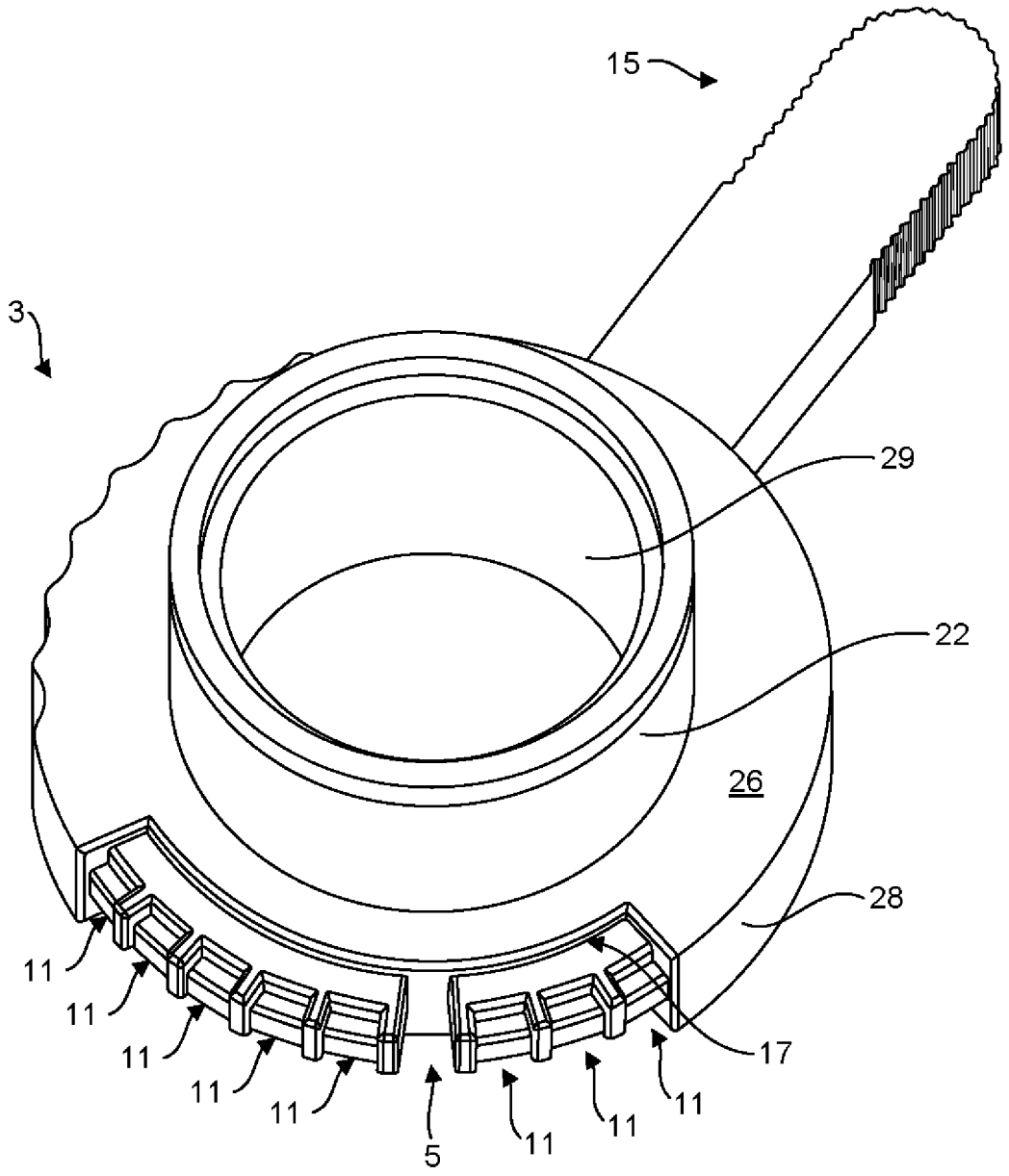
FIG. 2 is view of a tumbler of FIG. 1 from the perspective of facing the distal end of the device.
Figure 3:
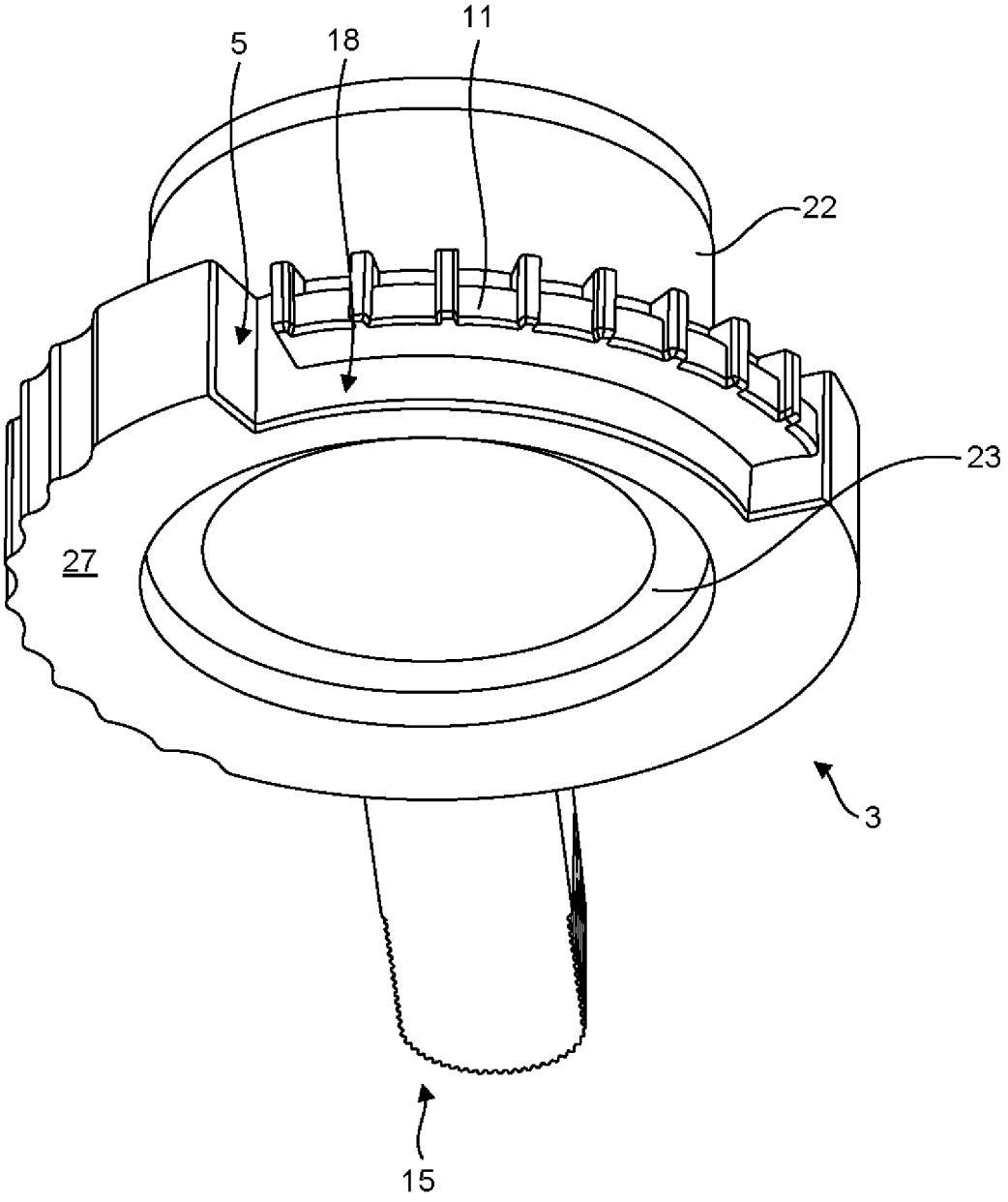
FIG. 3 is a view of a tumbler of FIG. 1 from the perspective of facing the proximate end of the device.
Figure 4:
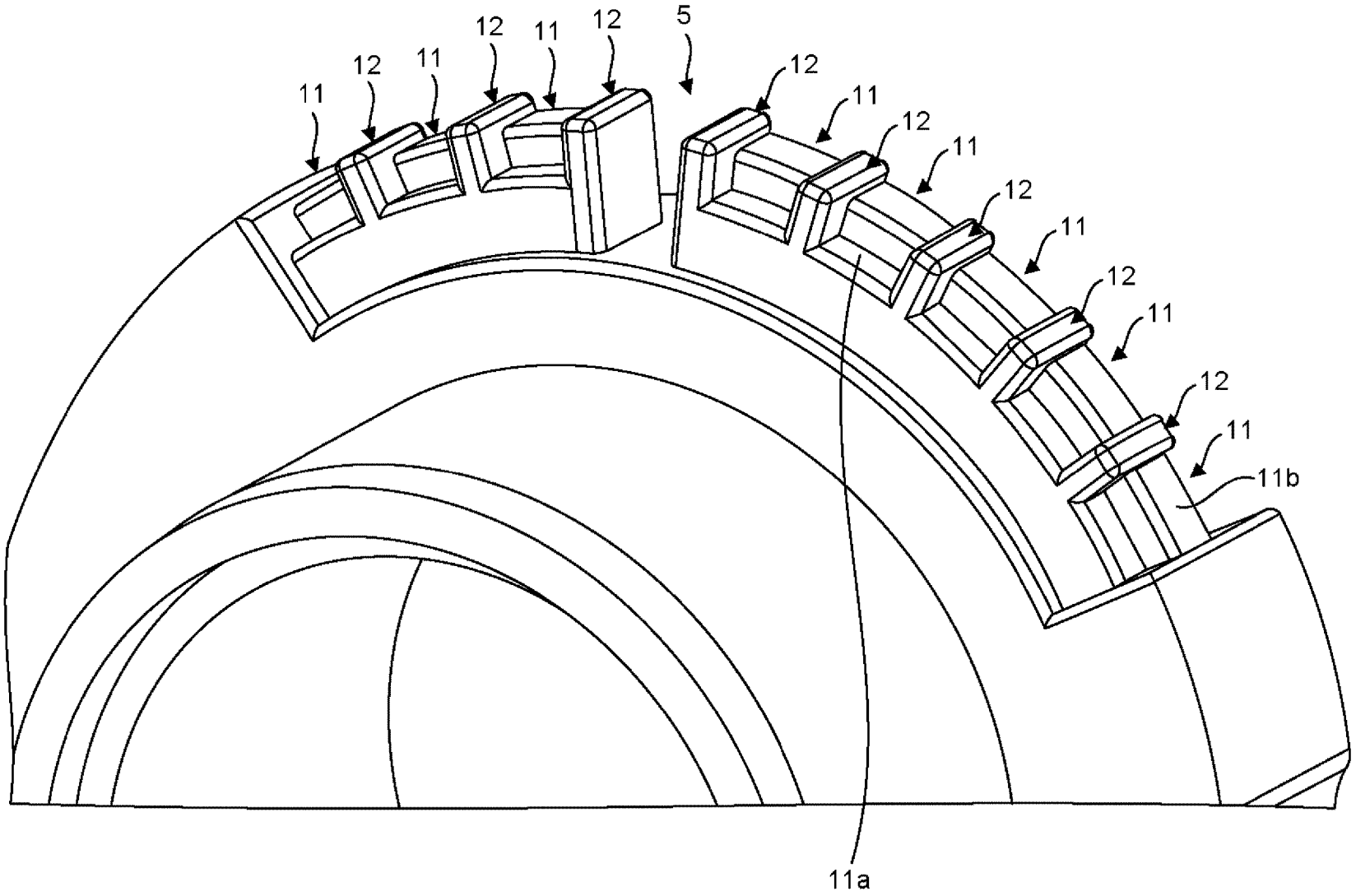
FIG. 4 is a detail view of a part of a tumbler of FIG. 1 from the perspective of facing the distal end of the device showing the false gates and the real gate.
Figure 5:
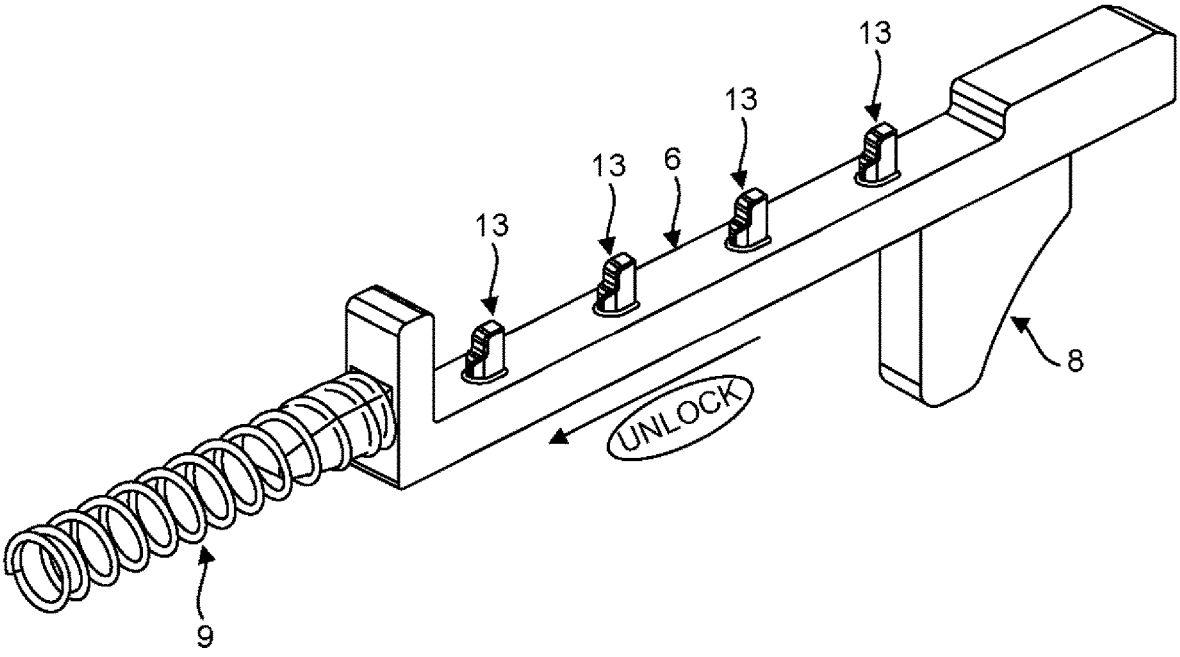
FIG. 5 is a view of the comb and attached spring enabling movement of the comb within the assembled lock.

FIGS. 2, 3 and 4 show the tumblers 3 that are incorporated into the locking device. The tumblers have a cylindrical form with first and second parallel (or substantially parallel) faces 26 and 27 and inner and outer circumferential surfaces 28 and 29. The region of the tumblers comprising an outer circumferential edge has a plurality of outer circumferential edge positions, one of which is a real gate 5 comprising a void of a given width and a given radial extent. Other positions of the circumferential edge positions of a given tumbler are false gates 11 with a void of a reduced radial extent. The tumblers are arranged linearly along a linear axis. Each of the tumblers 3 may rotate about the spindle 4 (although the spindle 4 is not illustrated in FIGS. 2-4); FIG. 2 is from the perspective facing the distal end of the device and FIG. 3 is from the perspective facing the proximate end of the device. The real gate 5 of a tumbler establishes the coded position of that tumbler. The comb 6 has a number of teeth 13 equal to the number of tumblers. The notch 5 is sized, in relation to the radius of the tumbler, the size of the comb 6, the size (width, length and height, see FIGS. 5-7) of the teeth 13 and the offset between the axis of the tumbler and the location of the comb, to allow each tooth 13 to pass the adjacent tumbler when the tumbler is in its coded position. A tooth 13 of the comb 6 is spaced from an adjacent tooth 13 by substantially the same distance which exists between adjacent tumblers. Consequently, a tooth 13 of the comb will pass a tumbler at substantially the same time as another tooth 13 of the comb will pass a different tumbler. In addition to notch 5, the tumblers 3 have plural false gates 11, each radially spaced about the circumference of the tumbler 3 from the notch 5 and other gates (seen best in FIGS. 4 and 7). As shown in FIGS. 4 and 7 the dimensions of the false gates 11 (particularly its extent in a radial direction) are selected in relation to the dimensions of the comb 6 and the teeth 13 so as to prevent the comb 6 from passing a tumbler 3 in the event a tooth 13 intersects with a false gate 11 of that tumbler. Between each of the false gates 11 and between the notch 5 and adjacent gates 11 is a rib 12 that helps guide the teeth 13 of comb 6 through the notch 5 and that reinforces the structural integrity of the tumblers 3.

An important function of the rib 12 is to prevent a lock picker from acquiring information about the location of the true gate by putting pressure on the comb while rotating a tumbler. The false gates 11 include ridges 11*a* and 11*b* at different radial distances from an axis which further serves to prevent useful information from being derived by probing the lock. Each of the tumblers 3 also includes a user tab 15. The tumbler may be rotated by application of a force to the user tab 15. Tumblers 3 also include hubs 22 and recess 23 in their faces. A hub 22 of a tumbler fits into recess 23 of an adjacent tumbler. This arrangement maintains physical contact between adjacent tumblers. This physical contact is important to maintaining security of the code against attempts to manipulate the lock in order to acquire information about the code.

Figure 6:
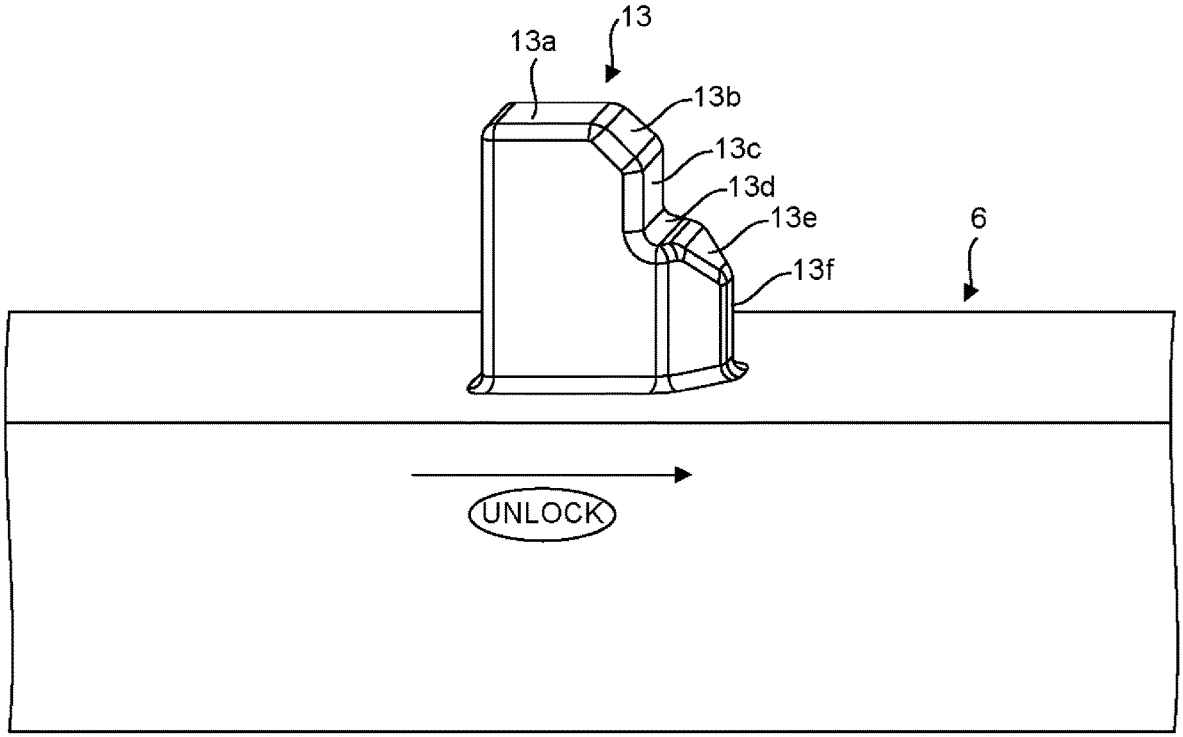
FIG. 6 is an isolated view of one tooth that is a component of the comb.
Figure 7:
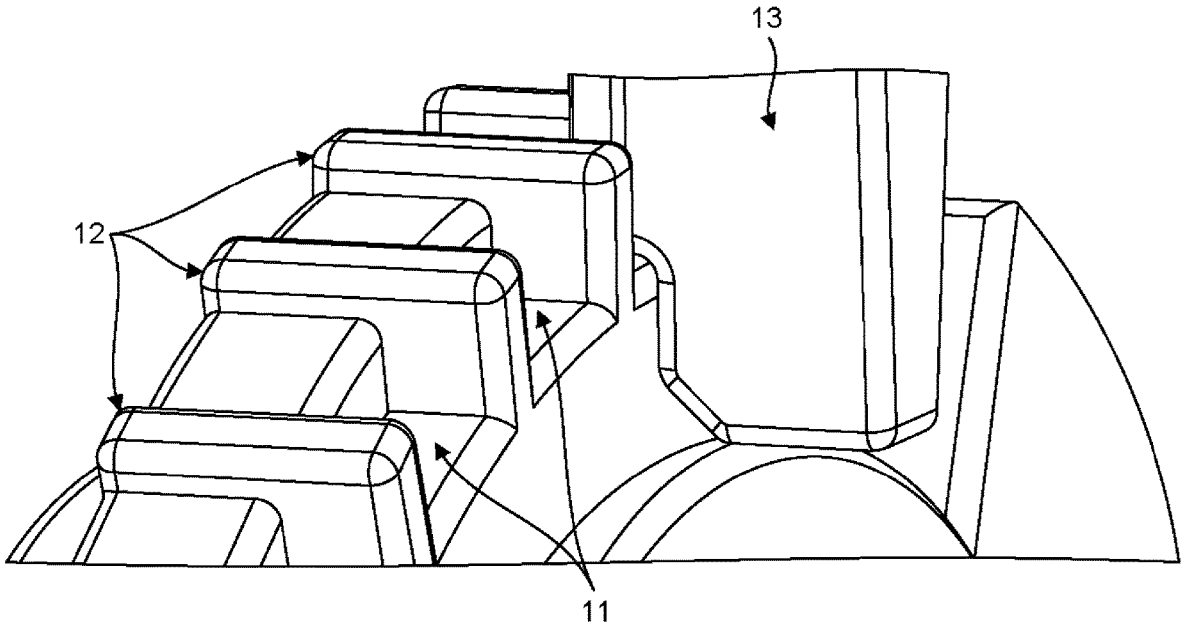
FIG. 7 is a view of a tumbler interacting with a tooth of the comb when the release tab is pushed toward the distal end of the lock without the tumbler being set in the coded position.

As shown in FIG. 6, each tooth is shaped in order to improve the feel of the device as the comb teeth enter either the false or real gates. The elements of the comb tooth include:

- 13*a*. Top of comb tooth, that is designed with adequate thickness to deter brute force tampering;
- 13*b*. chamfered tooth comb face, to prevent collision through the tumbler when in the coded position;
- 13*d*. radiused comb tooth, for strength;
- 13*e*. tapered comb tooth front face, to prevent collision going into the false gate;
- 13*f*. comb tooth front face, to go into the tumbler true gate and false gate By pushing the release tab 8 (FIG. 1) toward the distal end of the device, the teeth 13 of the comb 6 are biased to move toward the tumblers 3 (in the direction of the arrow in FIG. 6). When the user tab 8 is pushed toward the distal end of the device without all the tumblers being in the coded position, at least one comb tooth 13 will engage with a false gate 11 (as seen in FIG. 7). For someone pushing on the user tab 8, this will create an experience similar to the feel of the tab passing the tumbler when the tumbler is in the coded position. This experience keeps open this position as a potential coded position in the mind of someone attempting to acquire information about the coded position by manipulating the lock.

Figure 8:
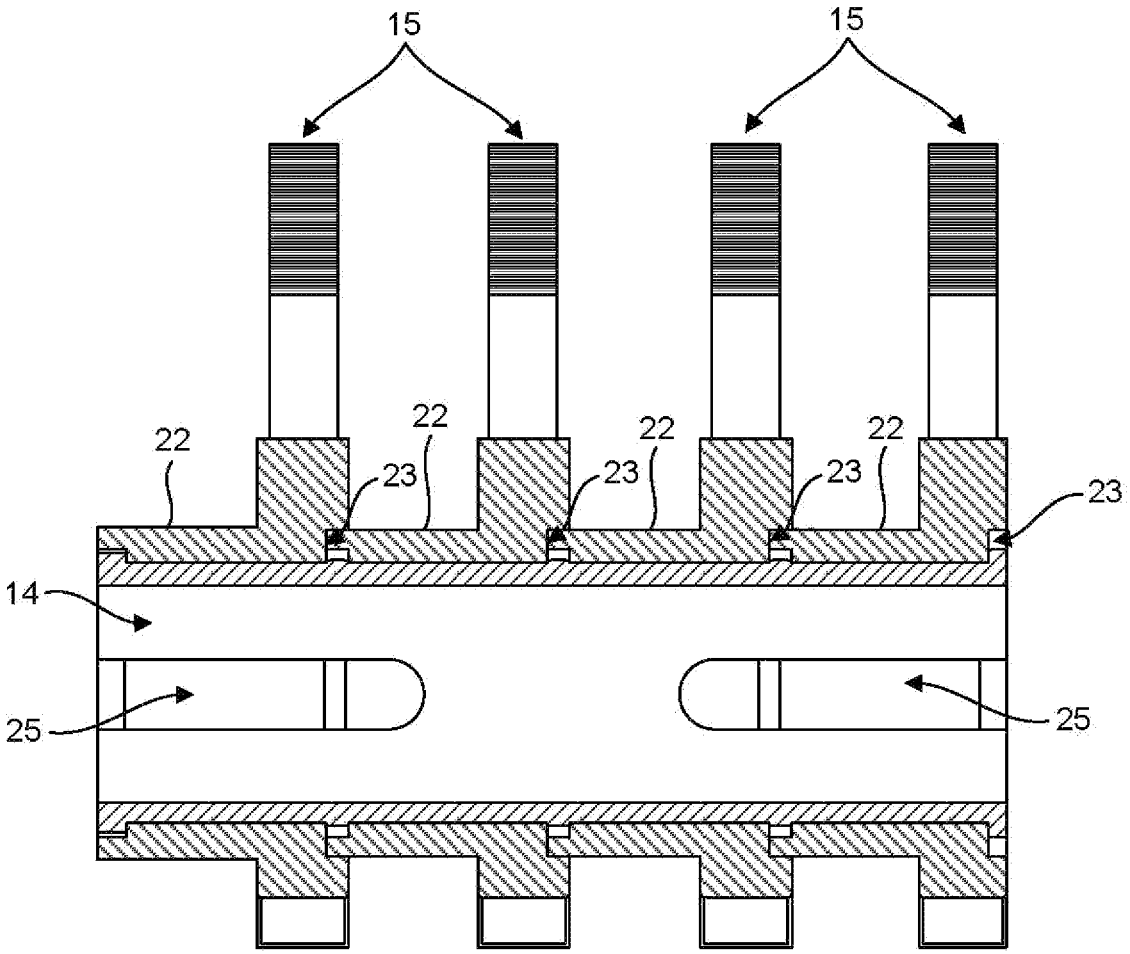
FIG. 8 is a mid-plane cross section of the lock housing and tumblers and sheath.
Figure 9:
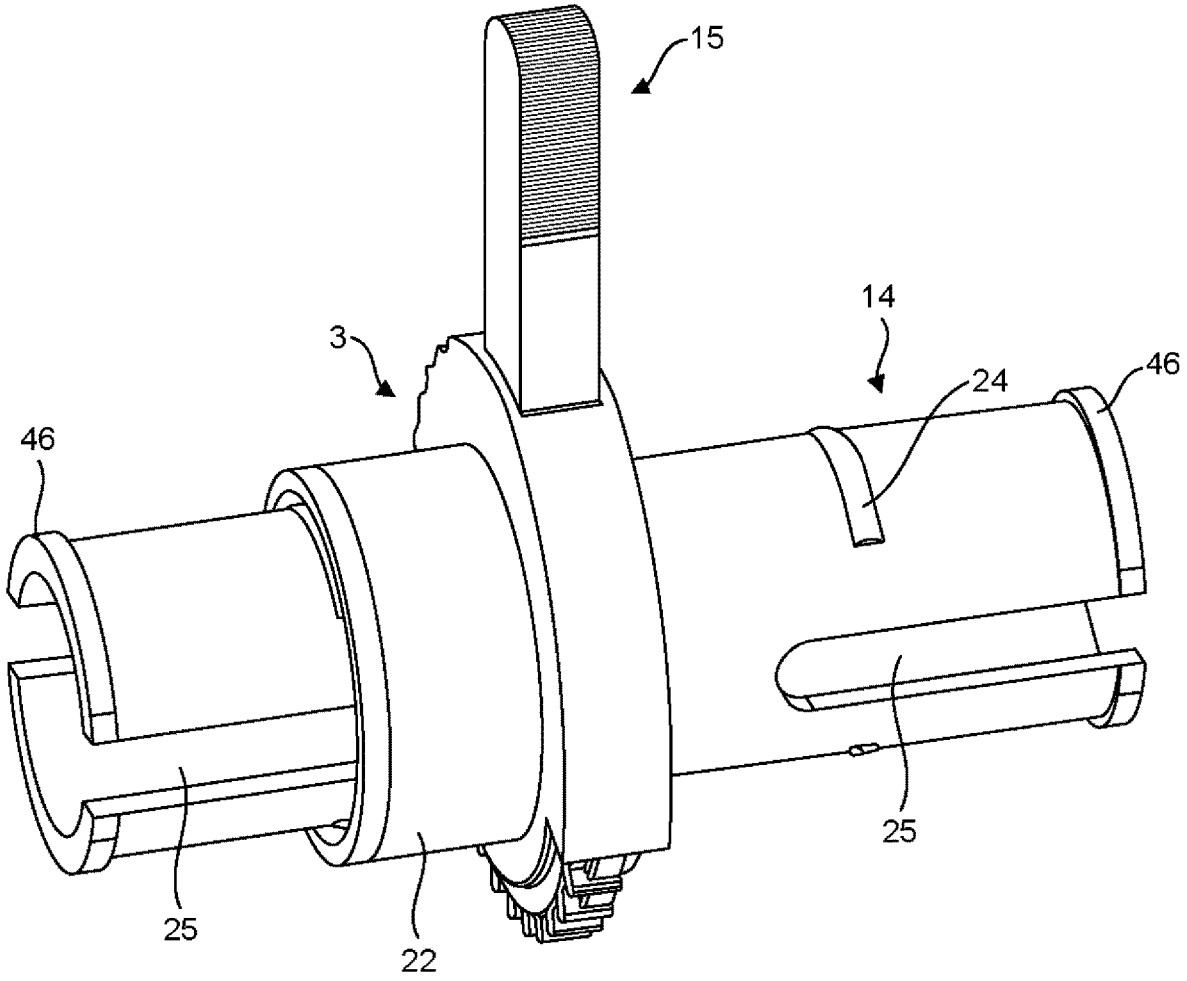
FIG. 9 is an isolated view of a single tumbler and an adjacent portion of the sheath.

In addition, the tumblers 3 are arrayed around a sheath 14 (FIGS. 1, 8 and 9) which surrounds a spindle 4 (not shown in FIGS. 8 and 9). The sheath 14 includes ridges 24 and 46 on the surface of the sheath. The ridges are part circumferential and parallel to each other and spaced to engage the edges of the hub and recess of a tumbler to maintain the positions of the tumblers in contact with neighboring tumblers. The sheath 14 and its interaction with the tumblers limits the information a user may obtain by manipulating the comb tab 8 to push the comb tooth 13 into the tumbler to derive information from the interaction by sensing the "feel" on the user tab 15. When the comb 6 is pushed into a tumbler 3, the tumbler 3 will push into the next tumbler 3 in the chain with the tumbler hub 22 until the end when the last tumbler in line will push into the sheath 14, which will pull the first tumbler recess 23. This makes it difficult for a user to deduce the combination by feeling for collisions between the comb teeth and the tumblers. The lips 46 on the ends of the sheath 14 engage with the recess 23 of the first tumbler in line (i.e., the tumbler closest to the knob 7) to pull on that tumbler when the comb 6 is pushed on. This reduces a lockpicker's ability to read which tumbler the comb is interacting with when pressed. The middle ridges 24 of the sheath align the tumblers in the correct position during assembly. The cutouts 25 in the sheath 14 allow the sheath to flex inwards while the tumblers are being assembled onto the sheath.

The sheath 14 provides an additional level of continual contact among the tumblers 3 in conjunction with tumbler hub 22 and recess 23. This contact causes each tumbler to provide similar information, for example through vibration, to an unauthorized person attempting to manipulate the lock by jostling it. In the absence of the sheath 14 a tumbler might be isolated so as to provide clues to an unauthorized manipulator about the coded position, for example through vibration or lack thereof when the manipulator performs certain pushing or pulling motions on the comb tab 8 and the tumbler user tab 15. The sheath 14 is preferably plastic, such as POM (Delrin).

Figure 10:
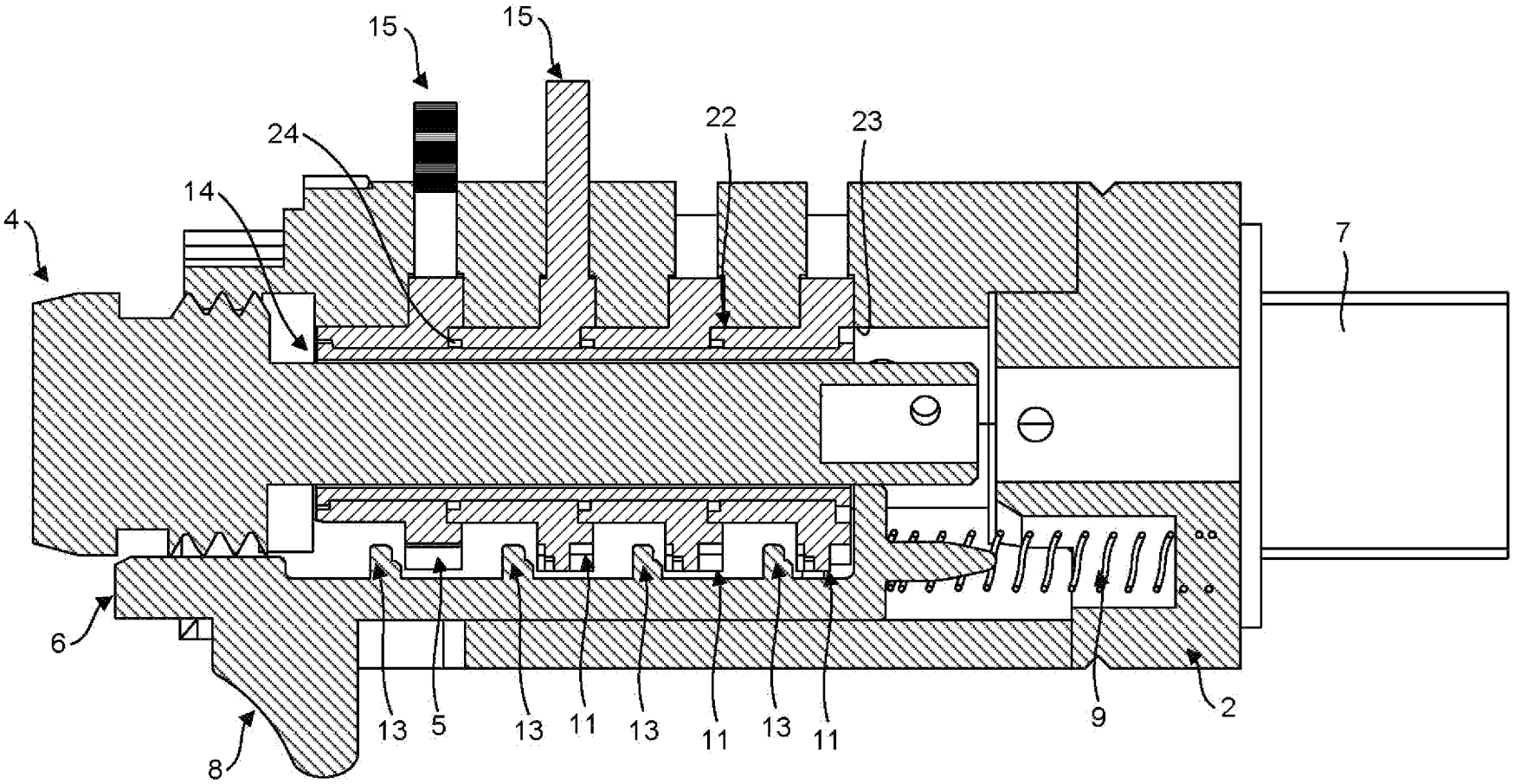
FIG. 10 is a mid-plane cross section of a portion of the gun lock showing the sheath, tumblers (in different positions) spindle and housing assembled into the lock

As shown in FIGS. 9 and 10, the tumbler user tab 15 is thinner than the remainder of the tumbler. The user tab 15 fits through the hemispheric opening 16. The elements of the tumbler that sit within the base housing 1 are thicker than the user tab. Therefore, anyone attempting to determine the coded position by inserting a shim designed to reach into the device through a hemispheric opening 16 is deterred by the need to shape a shim to account for the tumbler 3 being wider than the opening in which the shim is placed.

FIGS. 2, 3 and 4 also show the catch basins 17 and 18 that sit immediately adjacent the false gates in the tumblers. The catch basins 17 facing the proximate end and catch basins 18 facing the distal end are located in different faces of the tumbler. These catch basins will disrupt the motion of a shim that is placed in the hemispheric opening, see FIG. 12, on either side of the tumbler 3. The presence of the catch basins 17 and 18 causes the shim to lose contact with the tumbler 3 as it gets closer to the gate section of the tumbler unless the manipulator finds a way to turn the shim inward when it reaches the catch basin. Assuming the manipulator can accomplish that maneuver, that person would need to turn the shim further inward in order to obtain meaningful information from the periphery of the tumbler that sits beyond the catch basin when the shim travels away from its entrance in the hemispheric opening.

The real gate 5 and false gates 11 are on the opposite side of the tumbler 3 from the user tab. This means that any shim that enters the device through a hemispheric opening 16 would need to pass by a substantial portion of the tumbler 3 in order to reach the notch 5, false gates 11 or catch basins 17 and 18. As shown with respect to a single tumbler in FIG. 9, if a shim is placed in the hemispheric opening, in order to provide information to a lock picker regarding the location of the gates, the shim needs to turn outward just beyond tab 15, cross all the way to the opposite side of the tumbler, turn inward approaching the catch basin and turn further inward in order to distinguish between false gates 11 and the real gate 5.

Figure 11:
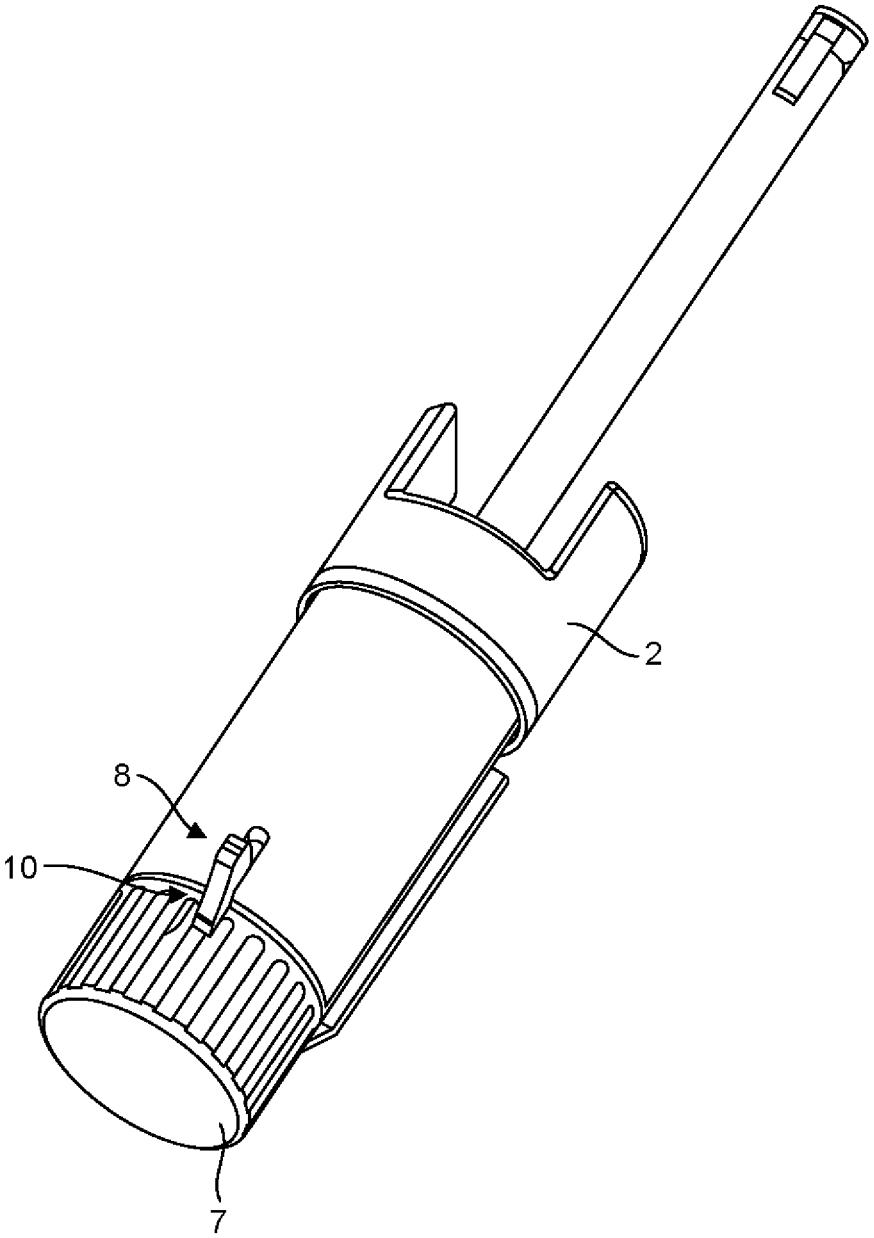
FIG. 11 is a view of an assembled gun lock looking toward the release tab and notch.

FIG. 11 shows a fully assembled firearm lock facing toward the notch 10 in the knob 7. This figure illustrates the lock in the locked position, meaning that release tab 8 is placed in notch 10, which prohibits the knob 7 from turning.

Figure 12:
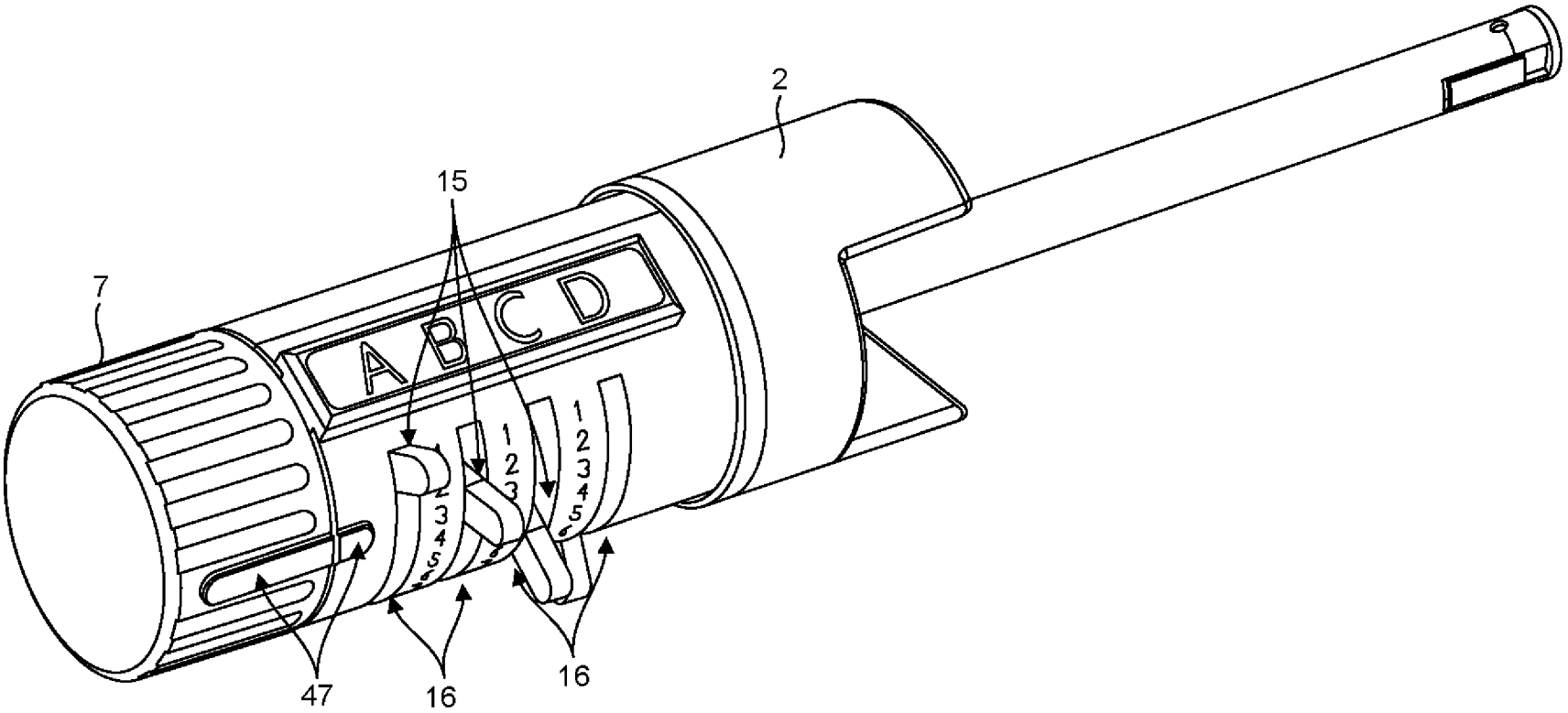
FIG. 12 is a view of an assembled gun lock facing the tumblers.

FIG. 12 also shows a fully assembled firearm lock showing the tumbler user tab 15 and the hemispheric openings 16.

The elements of the lock described herein can be used for many locking purposes beyond the firearm lock that is displayed in FIG. 1.

Figure 13:
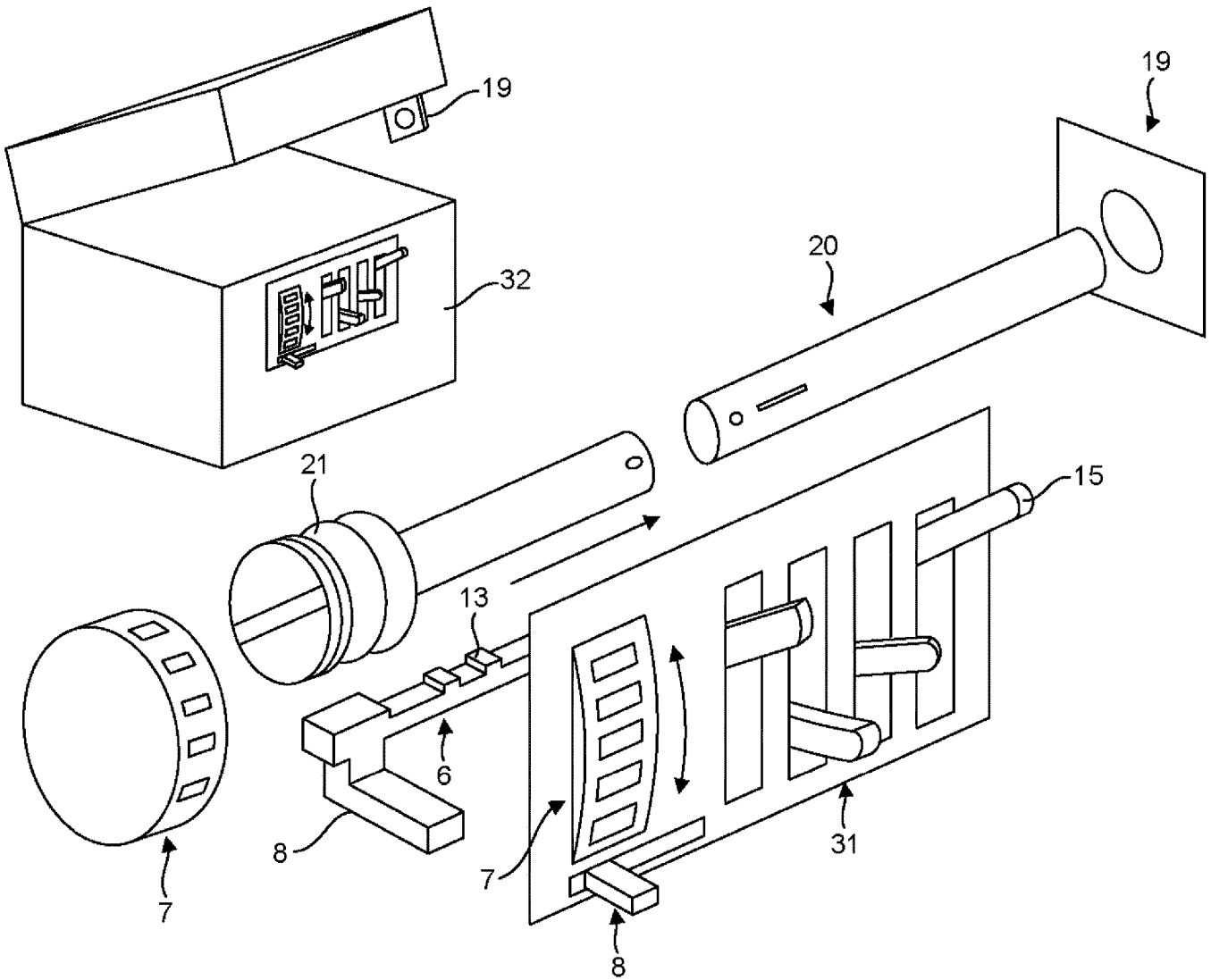
FIG. 13 is an exploded view of second embodiment illustrating a container which may be protected by the lock which is incorporated into the container and also illustrates how the lock interacts with parts of the container.

FIG. 13 shows how the mechanism of a storage locker or container lock embodiment works in conjunction with certain lock components from the gun lock embodiment. FIG. 13 shows a container 32 which contains a lock mechanism similar to that already described, including a panel 31 in the wall of the container 32 through which is accessible user tabs 15 of several tumblers (not illustrated), knob 7 and the user tab 8 of a comb 6. The container lock embodiment has many of the same components as the gun lock embodiment including the knob 7 with a notch 10 (not shown), plural tumblers 3, each with a user manipulatable tab 15 (the tumblers are hidden in FIG. 13 but the user tab 15 is shown), comb 6 with teeth 13 and spring 9 (not illustrated). As in the gunlock embodiment, when the all tumblers 3 achieve their coded positions, the comb 6 is free to translate. When the user applies a force to push the release tab 8 to the right, the resulting motion removes the tab from the notch 10 in the knob 7. When the release tab 8 is withdrawn from notch 10, the knob 7 is free to rotate in response to user actuation.

When the user rotates the knob 7, the rotation produces through rotation of screw threads 21 translation of the rod 20, translation of the rod 20 translates between a lock position (forwardmost projection) and an unlock position (retreat toward the knob 7). The rod 20 acts as a deadbolt with respect to the receiver 19. When the rod 20 enters the receiver 19 the container cannot be accessed and is locked. When the rod 20 withdraws from the receiver 19 the container is unlocked and its contents may be accessed.

Although not illustrated in FIG. 13, the container embodiment includes the same engagement between the tumblers 3 and the sheath 14 as illustrated in FIGS. 8-10.

The parts of both the gunlock and container lock embodiments may be fashioned from a variety of materials. In general, many of the components may be stainless steel or other similar metal. However, the spindle 4, or 20 is preferably bronze. There are a few plastic pieces, such as the components at the distal end of the gunlock which is inserted into the barrel of a weapon (see Ser. No. 16/876,846 for a description of these components), the A,B,C,D indicator on the housing (see FIG. 12), the boot covering the base receiver cap 2, and a small strip aligned on the housing and knob to show when the lock is engaged (47).

What is claimed is:

1. A lock comprising:

a plurality of tumblers, each of cylindrical form having first and second faces generally parallel to each other, the tumblers arranged linearly along a common axis, each of the tumblers having inner and outer circumferential surfaces, said outer circumferential surface including an outer circumferential edge;

each of the tumblers including a plurality of distinct spaced outer circumferential edge locations, each of said outer circumferential edge locations occupying a different portion of the tumbler outer circumference and each adjacent to at least one other of said locations, said plural distinct locations of each tumbler including a single location comprising an outer circumferential void in a specified portion of the outer circumference extending a prescribed distance from said circumferential edge toward the axis, each said tumbler further including a plurality of other distinct locations representing a void in each of the other distinct locations extending less than said prescribed distance toward said axis, each of the tumblers also including a user tab, each of the tumblers also including a hub on the first face of the tumbler and a recess on the second face of the tumbler, the hub of one tumbler engaging a recess of an adjacent tumbler, the hub and recess of each tumbler defining the inner circumferential surface, a housing surrounding the plural tumblers, having an axis in common with the axis of the tumblers and having openings in the housing, each opening arranged to accommodate a different one of the tumbler user tabs, a spring biased comb located within said housing and urged by said spring in a first direction, said comb extending generally parallel to the common axis and having a plurality of teeth, equal in number to the number of tumblers, said teeth spaced by a distance equal to the distance between adjacent tumblers, said comb supported for movement parallel to said axis, each of said teeth extending toward said axis, each said tooth having a length allowing said tooth to pass by said single location but not pass by any of said other distinct locations of any tumbler, and a sheath having a cylindrical form located within said housing and contacting all said tumblers at said inner circumferential edges.

2. The lock of claim 1 wherein the user tab of each tumbler is located distant from the single location.

3. The lock of claim 2 wherein said comb includes a locking tab, and which lock further includes a knob supported colinear with said axis and journaled for rotation about said axis and having a recess for accepting said comb locking tab.

4. The lock of claim 1 wherein said sheath includes a plurality of circumferentially extending ridges, generally parallel to each other and spaced apart so adjacent ridges contact a single tumbler.

5. The lock of claim 1 wherein said sheath includes an outer surface, said outer surface including a plurality of circumferentially extending ridges, at least one said ridge parallel to another said ridge and spaced to surround a tumbler at an inner circumferential surface of said tumbler.

6. The lock of claim 5 wherein the sheath includes a first and second end, circumferentially extending ridges located at said first and second ends engaged with inner circumferential surfaces of different ones of said tumblers.

7. The lock of claim 1 wherein said circumferential void of said single location includes a circumferential segment at said prescribed distance, each of said other distinct locations including at least one segment at less than said prescribed distance from said circumferential edge toward said axis.

8. The lock of claim 7 wherein at least some of said other distinct locations include plural segments, each said segment of said other distinct locations located a different distance from said circumferential edge, all said different distances less than said prescribed distance.

9. The lock of claim 1 wherein each of said outer circumferential edge locations is separated from another of said outer circumferential edge locations by an upstanding rib directed radially outward from said axis.

10. The lock of claim 9 wherein said sheath includes a plurality of circumferentially extending ridges, generally parallel to each other and spaced apart so adjacent ridges contact a single tumbler.

11. The lock of claim 9 wherein said sheath includes an outer surface, said outer surface including a plurality of circumferentially extending ridges, at least one said ridge parallel to another said ridge and spaced to surround a tumbler at an inner circumferential surface of said tumbler.

12. The lock of claim 9 wherein the sheath includes a first and second end, circumferentially extending ridges located at said first and second ends engaged with inner circumferential surfaces of different ones of said tumblers.

* * * * *